US009501030B2

(12) United States Patent
Shiraki et al.

(10) Patent No.: US 9,501,030 B2
(45) Date of Patent: Nov. 22, 2016

(54) IMAGE FORMING APPARATUS

(71) Applicant: Brother Kogyo Kabushiki Kaisha, Nagoya-shi, Aichi-ken (JP)

(72) Inventors: Masatoshi Shiraki, Nagoya (JP); Yuichi Matsushita, Nagoya (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/868,501

(22) Filed: Sep. 29, 2015

(65) Prior Publication Data

US 2016/0091858 A1 Mar. 31, 2016

(30) Foreign Application Priority Data

Sep. 29, 2014 (JP) ..... 2014-198792

(51) Int. Cl.
*G03G 21/00* (2006.01)
*G03G 21/16* (2006.01)

(52) U.S. Cl.
CPC ..... *G03G 21/1676* (2013.01); *G03G 21/1633* (2013.01); *G03G 2215/0141* (2013.01); *G03G 2215/1623* (2013.01); *G03G 2221/1684* (2013.01)

(58) Field of Classification Search
CPC ..... G03G 21/1676; G03G 21/1633; G03G 2215/0141; G03G 2215/1623; G03G 2215/1684
See application file for complete search history.

(56) References Cited

U.S. PATENT DOCUMENTS 5,053,816 A * 10/1991 Takahashi ..... G03G 15/0822 399/12
6,298,202 B1 * 10/2001 Fushiya ..... G03G 21/181 399/113
7,116,919 B2 * 10/2006 Ishii ..... G03G 15/0896 399/111
7,509,072 B2 * 3/2009 Nagahama ..... G03G 21/1882 399/114
7,986,906 B2 * 7/2011 Okabe ..... G03G 15/0813 399/228
8,463,145 B2 * 6/2013 Ukai ..... G03G 21/1896 399/111
8,995,846 B2 * 3/2015 Itabashi ..... G03G 21/1857 399/111
9,207,567 B2 * 12/2015 Mushika ..... G03G 15/0863
2009/0279905 A1 * 11/2009 Zensai ..... G03G 15/1605 399/12
2010/0316413 A1 * 12/2010 Murasaki ..... G03G 15/0194 399/228

FOREIGN PATENT DOCUMENTS

JP 2001-042585 A 2/2001

* cited by examiner

*Primary Examiner* — Walter L Lindsay, Jr.
*Assistant Examiner* — Ruifeng Pu
(74) *Attorney, Agent, or Firm* — Banner & Witcoff, Ltd.

(57) ABSTRACT

An image forming apparatus including a main body, a photoconductive drum, a development cartridge including a development roller, a switching mechanism configured to switch between a contact state where the development roller and the photoconductive drum are in contact with each other, and a separate state where the development roller and the photoconductive drum are separated away from each other, and a controller configured to perform a preparatory mode to make preparations for forming a developer image on the photoconductive drum and transferring onto a transfer object the developer image formed on the photoconductive drum, and during execution of the preparatory mode, rotate the development roller while maintaining the separate state between the development roller and the photoconductive drum.

23 Claims, 11 Drawing Sheets

REAR ⟷ FRONT
FIG. 6A COLOR MODE
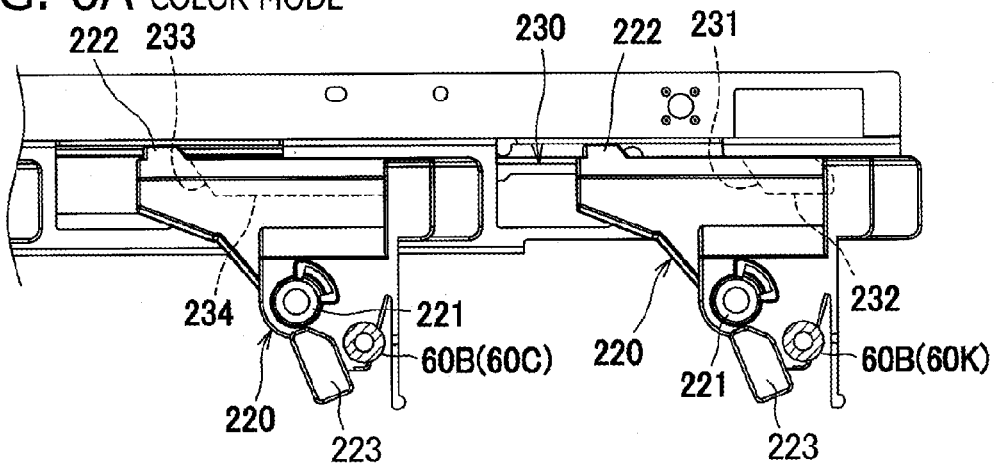
FIG. 6B MONOCHROME MODE
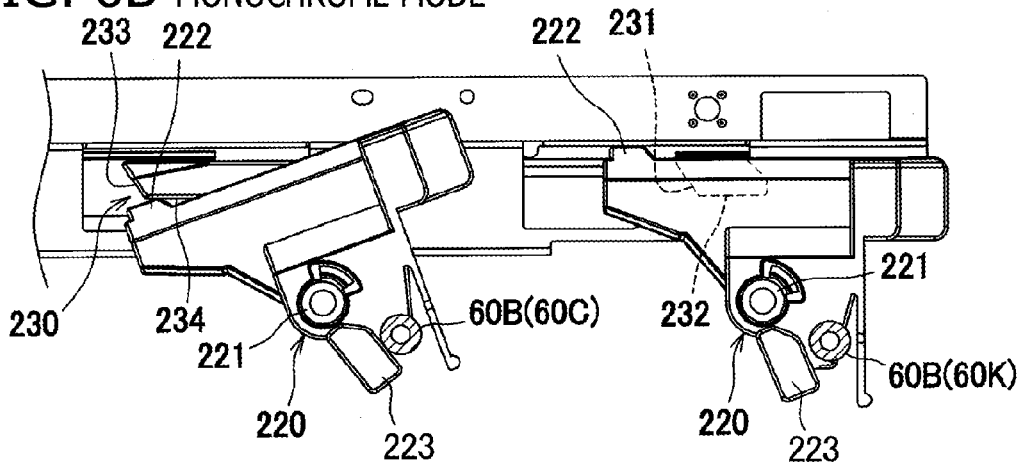
FIG. 6C ALL SEPARATION MODE
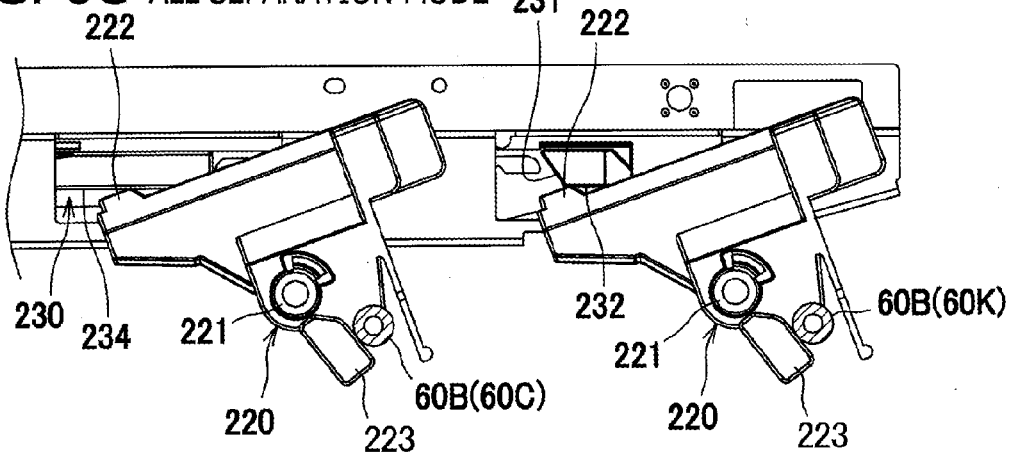

IMAGE FORMING APPARATUS

CROSS-REFERENCE TO RELATED APPLICATION

This application claims priority under 35 U.S.C. §119 from Japanese Patent Application No. 2014-198792 filed on Sep. 29, 2014. The entire subject matter of the application is incorporated herein by reference.

BACKGROUND

Technical Field

The following description relates to one or more aspects of an image forming apparatus including a development unit having a development roller, the development unit being detachably attached to a main body of the apparatus.

Related Art

An image forming apparatus has been known that includes a development unit having a development roller, the development unit being detachably attached to a main body of the apparatus, and that is configured to determine whether the development unit is new, as a preparatory operation before an image formation operation of forming an image on a sheet.

SUMMARY

In the meantime, in a situation where a photoconductive drum is in contact with a development roller during execution of the preparatory operation, when the development roller is rotating, development agent (hereinafter referred to as "developer") might be supplied from the development roller to the photoconductive drum. Thus, the photoconductive drum might be contaminated with the developer, and/or the developer might be wastefully consumed.

According to aspects of the present disclosure, an image forming apparatus is provided, which includes a main body, a photoconductive drum, a development cartridge including a development roller, a switching mechanism configured to switch between a contact state where the development roller and the photoconductive drum are in contact with each other, and a separate state where the development roller and the photoconductive drum are separated away from each other, and a controller configured to perform a preparatory mode to make preparations for forming a developer image on the photoconductive drum and transferring onto a transfer object the developer image formed on the photoconductive drum, and during execution of the preparatory mode, rotate the development roller while maintaining the separate state between the development roller and the photoconductive drum.

According to aspects of the present disclosure, further provided is an image forming apparatus that includes a main body, a photoconductive drum, a development cartridge including a development roller, a switching mechanism configured to switch between a contact state where the development roller and the photoconductive drum are in contact with each other, and a separate state where the development roller and the photoconductive drum are separated away from each other, and a controller configured to perform an initializing operation of making preparations for an image forming operation, in the initializing operation, perform a preparatory mode to make preparations for forming a developer image on the photoconductive drum and transferring onto a transfer object the developer image formed on the photoconductive drum, and during execution of the preparatory mode, rotate the development roller while maintaining the separate state between the development roller and the photoconductive drum.

BRIEF DESCRIPTION OF THE ACCOMPANYING DRAWINGS

FIG. 6A shows a positional relationship between cam surfaces and the separating members in a color mode in the first illustrative embodiment according to one or more aspects of the present disclosure.

FIG. 6B shows a positional relationship between the cam surfaces and the separating members in a monochrome mode in the first illustrative embodiment according to one or more aspects of the present disclosure.

FIG. 6C shows a positional relationship between the cam surfaces and the separating members in an all separation mode in the first illustrative embodiment according to one or more aspects of the present disclosure.

Figure 8:
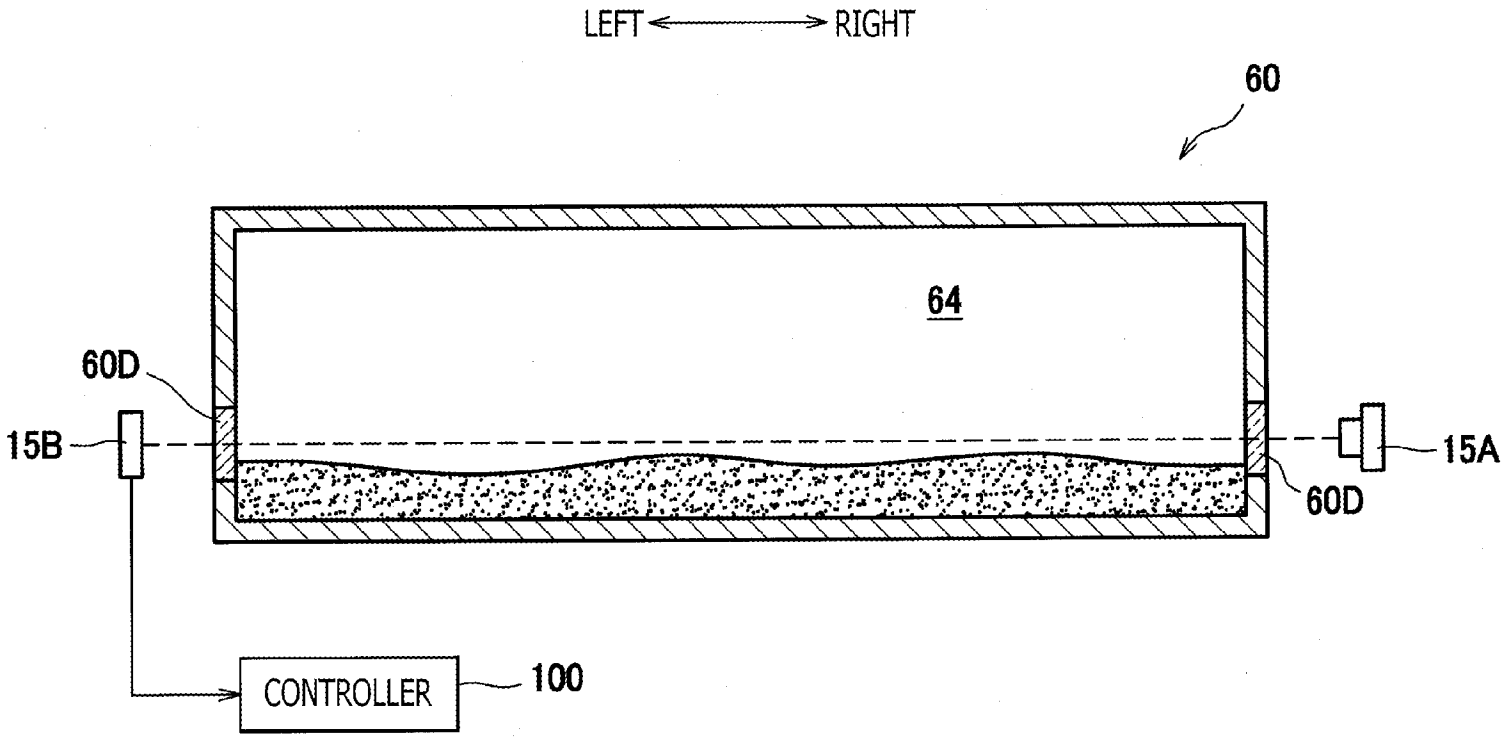

FIG. 8 schematically shows a configuration for determining an amount of toner remaining in the development cartridge, in the first illustrative embodiment according to one or more aspects of the present disclosure.

Figure 9:
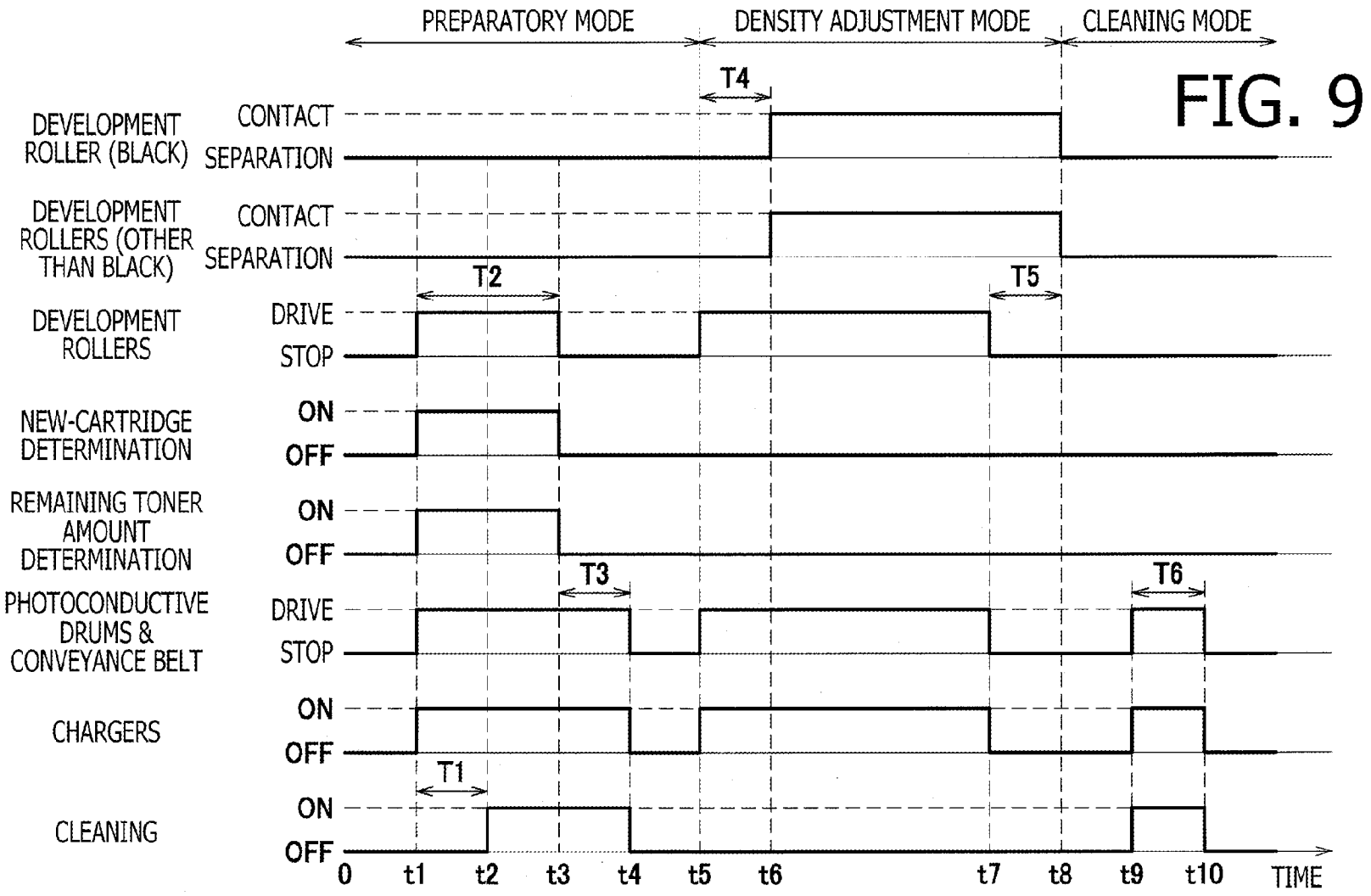

FIG. 9 is a timing chart of an initializing operation in the first illustrative embodiment according to one or more aspects of the present disclosure.

Figure 10:
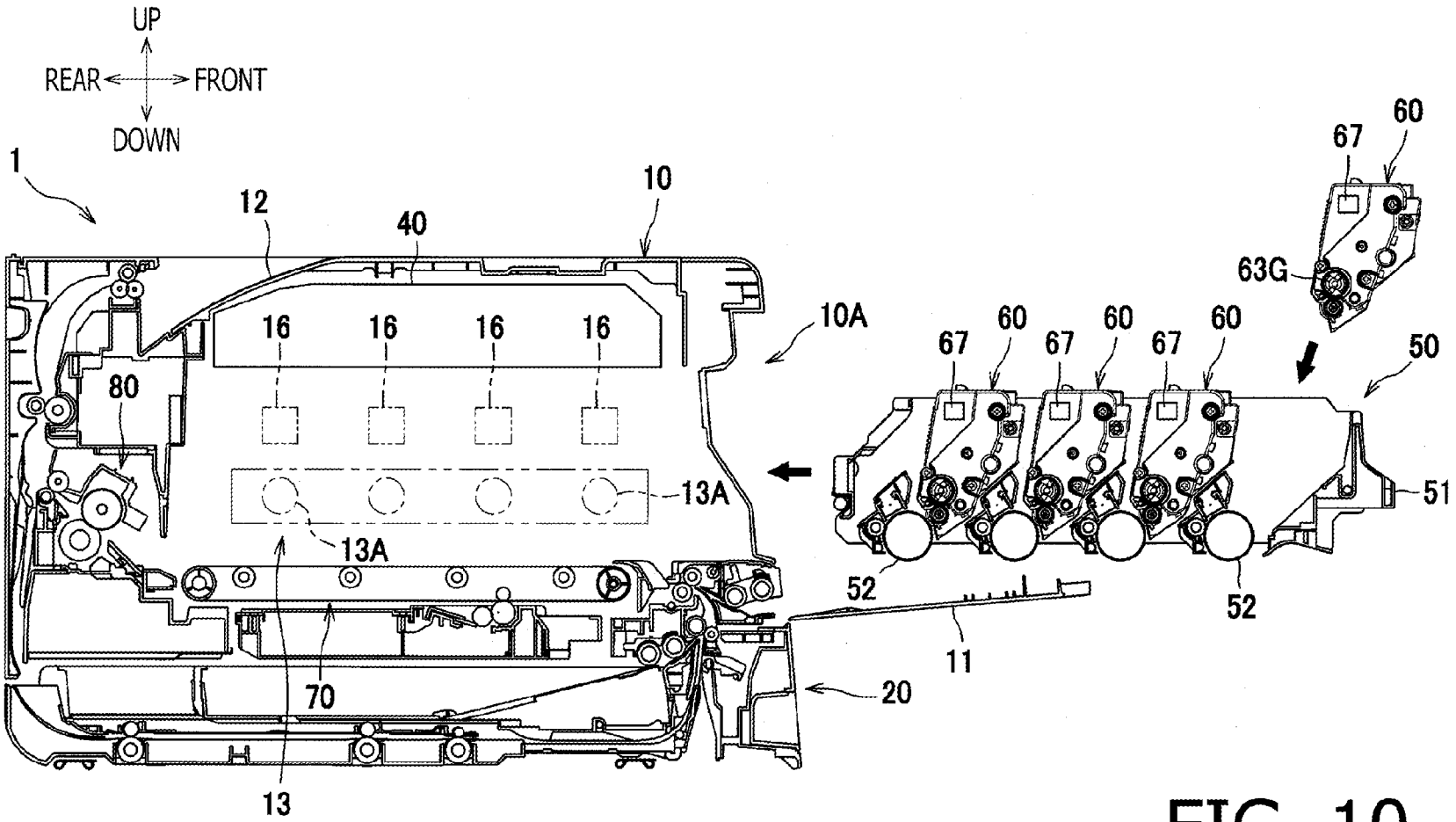

FIG. 10 shows a color printer in a state where a front cover is open, and where a drawer is pulled out of a main body, in a second illustrative embodiment according to one or more aspects of the present disclosure.

Figure 11:
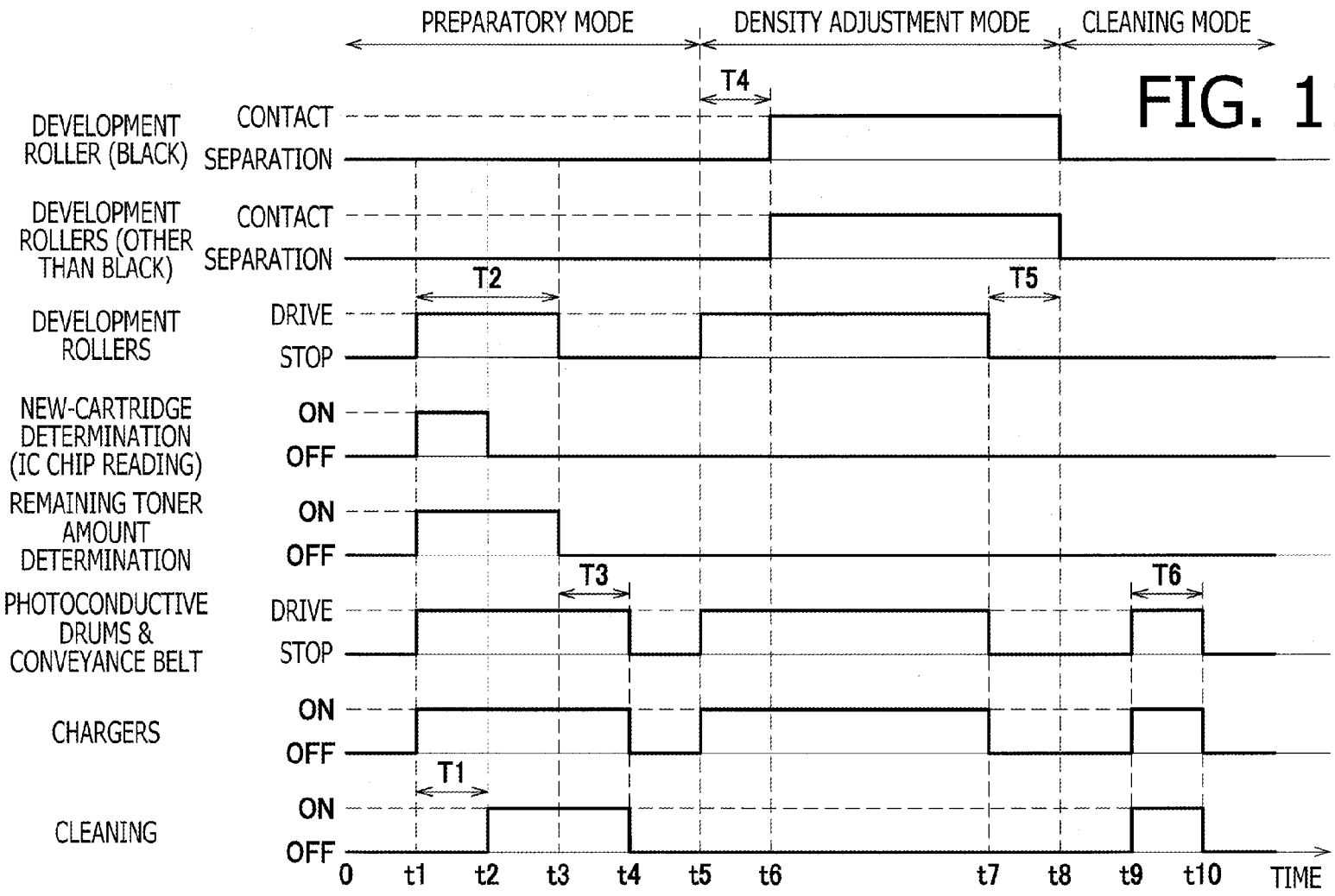

FIG. 11 is a timing chart of an initializing operation in the second illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, illustrative embodiments according to aspects of the present disclosure will be described with reference to the accompanying drawings.

First Illustrative Embodiment

In the following description, each direction of an image forming apparatus according to aspects of the present disclosure will be defined on the basis of a view from a user of the apparatus. Specifically, when the apparatus is viewed from the user, a near side (i.e., a right side in FIG. 1) and a far side (i.e., a left side in FIG. 1) of the apparatus will be defined as a front side and a rear side of the apparatus, respectively. In addition, a near side and a far side with respect to a plane surface of FIG. 1 will be defined as a left side and a right side of the apparatus, respectively. Further, an upper side and a lower side in FIG. 1 will be defined as an upper side (upside) and a lower side (downside) of the apparatus, respectively.

<Overall Configuration of Color Printer>

Figure 1:
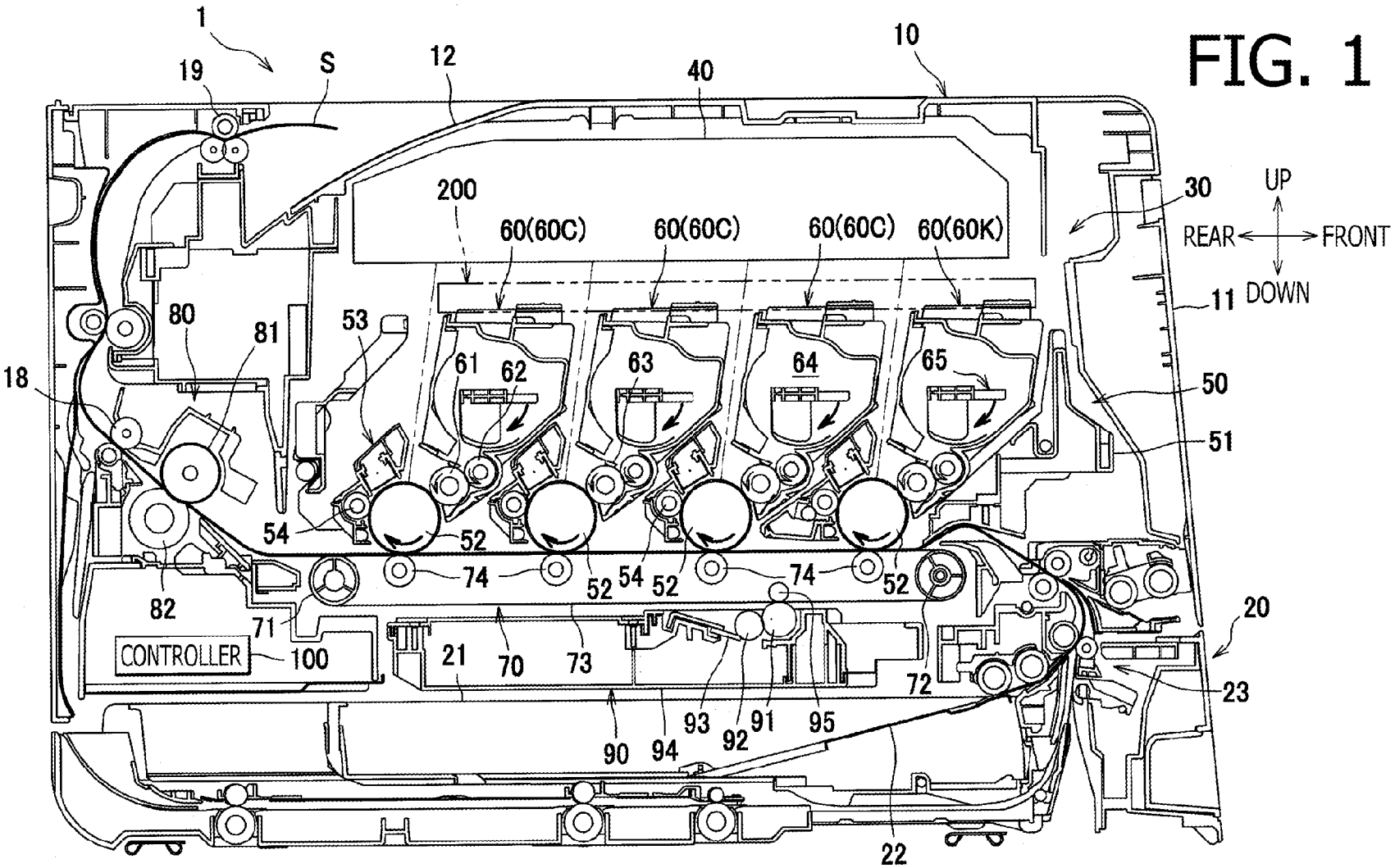
FIG. 1 is a cross-sectional side view schematically showing a configuration of a color printer in a first illustrative embodiment according to one or more aspects of the present disclosure.

As shown in FIG. 1, a color printer 1, which is an example of the image forming apparatus according to aspects of the present disclosure, includes a main body 10, a sheet feeder 20, an image forming unit 30, a cleaning unit 90, and a controller 100. The image forming unit 30, the cleaning unit 90, and the controller 100 are disposed inside the main body 10.

Figure 2:
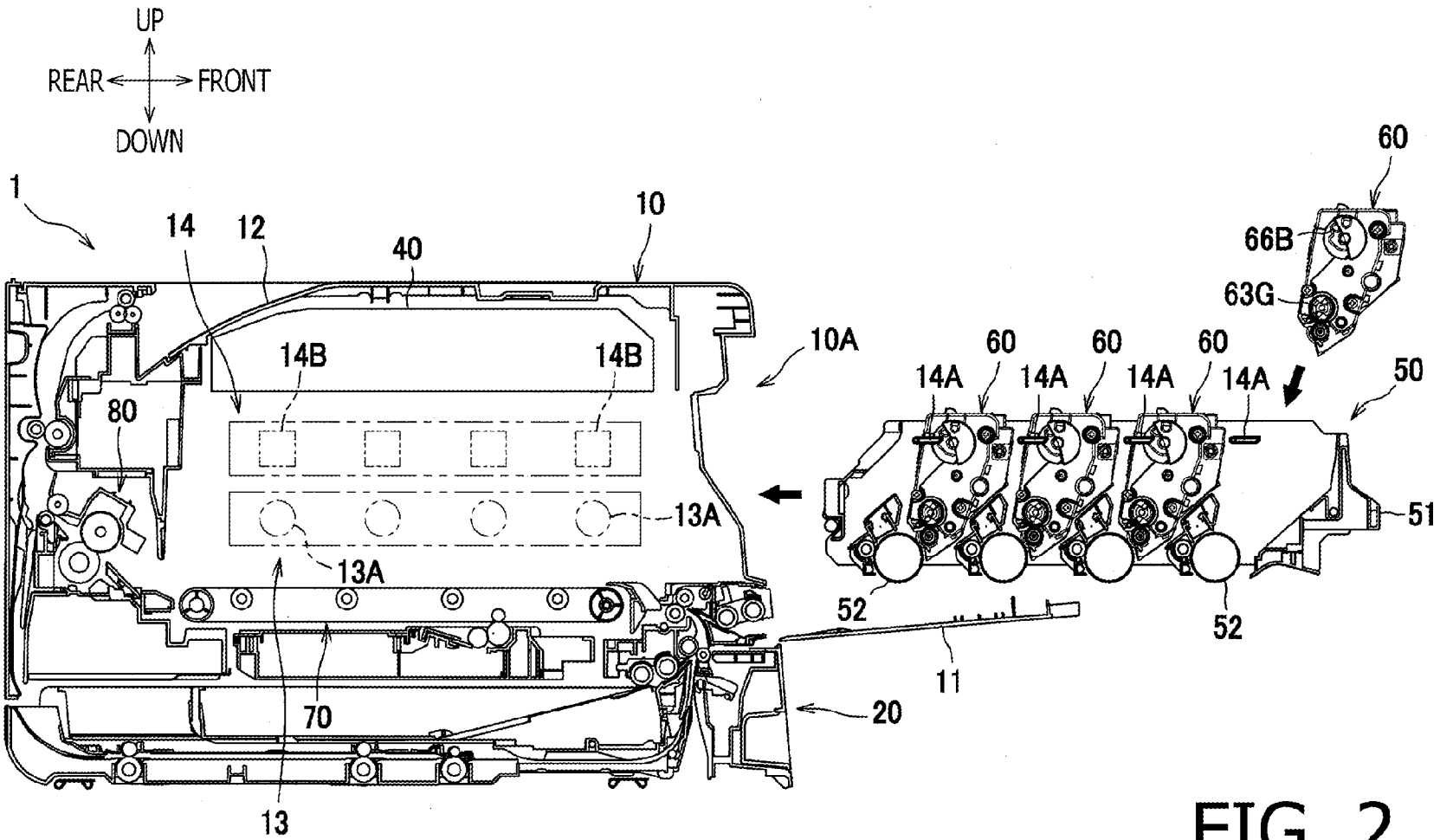
FIG. 2 shows the color printer in a state where a front cover is open, and where a drawer is pulled out of a main body, in the first illustrative embodiment according to one or more aspects of the present disclosure.

As shown in FIG. 2, the main body 10 has an opening 10A and a front cover 11 at a front end portion of the main body 10. The opening 10A is configured such that a below-mentioned process unit 50 is detachably attached to the main body 10 through the opening 10A. The front cover 11 is configured to be openable and closable relative to the main body 10 and shut the opening 10A when the front cover 11 is closed. The front cover 11 is rotatable around a lower end portion thereof, relative to the main body 10.

Referring back to FIG. 1, the sheet feeder 20 is disposed at a lower portion inside the main body 10. The sheet feeder 20 includes a feed tray 21, a sheet pressing plate 22, and a feeding mechanism 23. The feed tray 21 is configured to accommodate sheets S. The sheet feeder 20 is configured such that the sheets S set in the feed tray 21 is pushed up by the sheet pressing plate 22 and fed to the image forming unit 30 after being separated on a sheet-by-sheet basis by the feeding mechanism 23.

The image forming unit 30 includes an exposure unit 40, a process unit 50, a transfer unit 70, and a fuser unit 80.

The exposure unit 40 is disposed at an upper portion inside the main body 10. The exposure unit 40 includes laser sources (not shown) corresponding to colors such as black, yellow, magenta, and cyan, a polygon mirror (not shown), lenses (not shown), and reflecting mirrors (not shown). The exposure unit 40 is configured to expose a surface of each photoconductive drum 52 by scanning a corresponding one of laser beams (see alternate long and short dash lines) on the surface of each photoconductive drum 52 in accordance with image data.

The process unit 50 is disposed between the feed tray 21 and the exposure unit 40. The process unit 50 includes a drawer 51, four photoconductive drums 52, four chargers 53, four holding rollers 54, and four development cartridges 60. The photoconductive drums 52 are arranged along the front-to-rear direction. Each charger 53, each holding roller 54, and each development cartridge 60 are provided for a corresponding one of the photoconductive drums 52.

The drawer 51 is configured to hold various elements such as the photoconductive drums 52. As shown in FIG. 2, the drawer 51 is detachably attached to the main body 10 through the opening 10A when the front cover 11 is open. Thus, it is possible to replace the photoconductive drums 52 by replacing the drawer 51. Further, the drawer 51 is configured to support each development cartridge 60 in a detachable manner. Thereby, it is possible to individually replace each development cartridge 60 in a state where the drawer 51 is drawn out of the main body 10.

Each photoconductive drum 52 has an electrically-conductive cylindrical drum main body, on an outer circumferential surface of which with a photosensitive layer is formed. Each photoconductive drum 52 is rotatable in a rotational direction indicated by an arrow in FIG. 1. Each charger 53 includes a charging wire and a grid electrode shown without any reference characters. Each charger 53 is configured to evenly charge the surface of a corresponding one of the photoconductive drums 52.

Each holding roller 54 has a rotational metal shaft covered with an electrically-conductive formed elastic roller body. Each holding roller 54 is configured to, in forming a toner image on the corresponding photoconductive drum 52, retrieve and temporarily hold toner remaining on the surface of the photoconductive drum 52 after transferring. Further, each holding roller 54 is configured to, in cleaning the photoconductive drum 52, return the toner held thereby onto the photoconductive drum 52. The toner returned onto the photoconductive drum 52 is transferred onto a conveyance belt 73 and retrieved by the cleaning unit 90.

Each development cartridge 60 includes a development roller 61, a supply roller 62, a layer thickness regulating blade 63, a container 64 configured to accommodate toner, and an agitator 65. The development roller 61 is configured to supply toner to the corresponding photoconductive drum 53. The agitator 65 is configured to agitate the toner in the container 64 while rotating. The toner in the container 64 is supplied from the supply roller 62 to the development roller 61, and carried on the development roller 61 after being regulated to a constant-thickness layer between the development roller 61 and the layer thickness regulating blade 63.

In the first illustrative embodiment, the development cartridges 60 are arranged in order of a development cartridge for accommodating black toner, a development cartridge for accommodating yellow toner, a development cartridge for accommodating magenta toner, and a development cartridge for accommodating cyan toner, from the front. Hereinafter, in the specification and the drawings, elements for black will be identified by the character "K" added to their reference characters. For instance, the development cartridge for black will be identified by reference characters "60K." Further, elements for the colors other than black will be identified by the character "C" added to their reference characters. For instance, the development cartridges for yellow, magenta, and cyan will be identified by reference characters "60C."

The transfer unit 70 is disposed between the feed tray 21 and the process unit 50. The transfer unit 70 includes a driving roller 71, a driven roller 72, a conveyance belt 73, and four transfer rollers 74. The conveyance belt 73 is an endless belt wound around the driving roller 71 and the driven roller 72. The conveyance belt is disposed to face the photoconductive drums 52. The four transfer rollers 74 are provided corresponding to the four photoconductive drums 52, respectively. Each of the transfer rollers 74 is disposed to face a corresponding one of the photoconductive drums 52 across the conveyance belt 73.

The fuser unit 80 is disposed behind the process unit 50 and the transfer unit 70. The fuser unit 80 includes a heating roller 81 and a pressing roller 82.

The image forming unit 30 charges the surfaces of the photoconductive drums 52 by the chargers 53 and exposes the surfaces of the photoconductive drums 52 by the exposure unit 40. Thereby, the image forming unit 30 forms an electrostatic latent image on each photoconductive drum 52. Next, the image forming unit 30 supplies toner carried on the development rollers 61 to the electrostatic latent images formed on the photoconductive drums 52. Thereby, the image forming unit 30 makes each electrostatic latent image visible and forms a toner image on each photoconductive drum 52. Thereafter, while conveying a sheet S fed from the feed tray 20, between the photoconductive drums 52 and the transfer rollers 74, the image forming unit 30 transfers onto the sheet S the toner images carried on the photoconductive drums 52. Then, when the sheet S with the toner images transferred thereon is conveyed between the heating roller 81 and the pressing roller 82, the toner images are thermally fixed. The sheet S with the toner images thermally fixed thereon is discharged onto a discharge tray 12 by a conveyance roller 18 and a discharge roller 19.

The cleaning unit 90 is disposed under the conveyance belt 73. The cleaning unit 90 includes a cleaning roller 91, a retrieving roller 92, a scraping blade 93, a storage portion 94, and a backup roller 95. The conveyance belt 73 is pinched between the backup roller 95 and the cleaning roller 91. The cleaning unit 90 is configured to retrieve, into the storage portion 94, toner adhering to the surface of the conveyance belt 73.

<Configuration of Switching Mechanism>

Figure 3B:
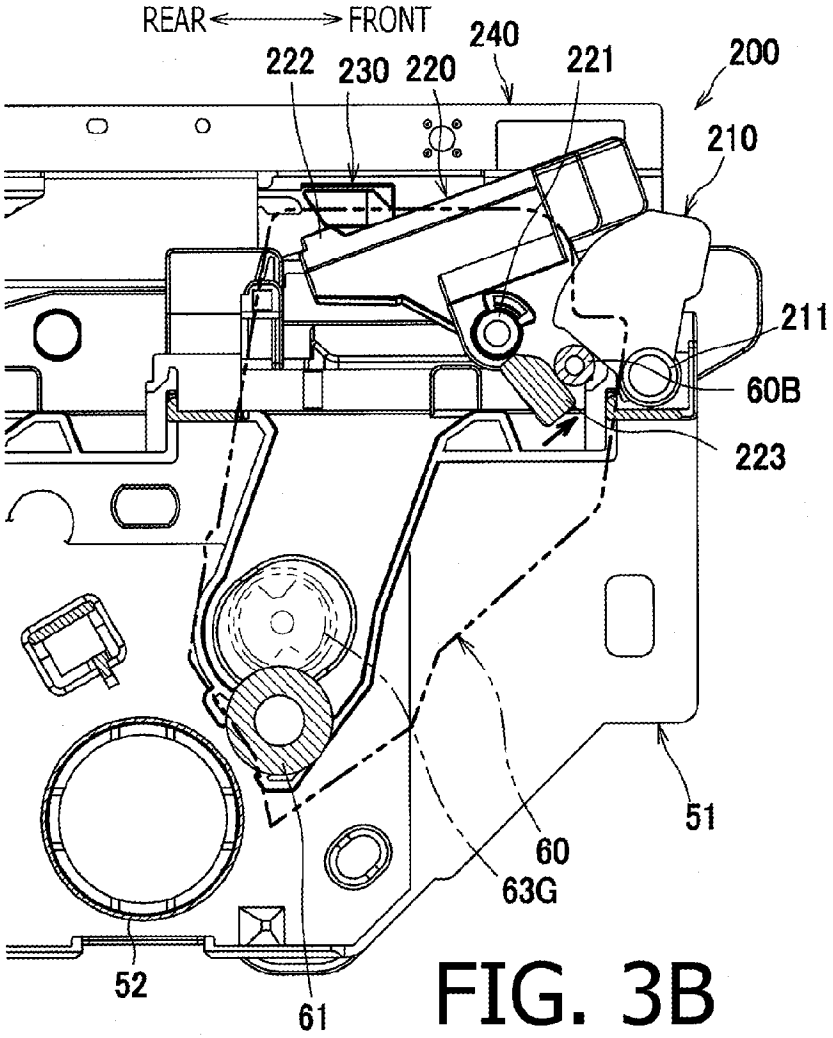
FIG. 3B shows a separate state where the development roller is separated away from the photoconductive drum, in the first illustrative embodiment according to one or more aspects of the present disclosure.
Figure 3A:
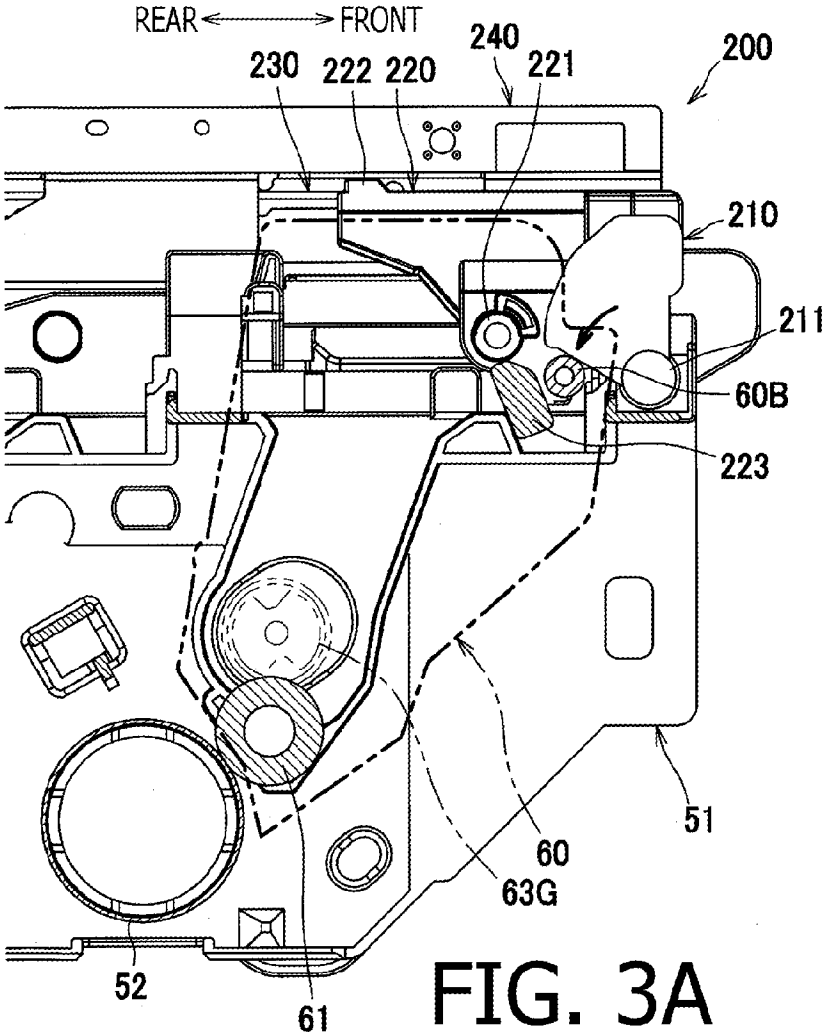
FIG. 3A shows a contact state where a development roller is in contact with a photoconductive drum, in the first illustrative embodiment according to one or more aspects of the present disclosure.

The color printer 1 includes a switching mechanism 200 configured to switch between a contact state shown in FIG. 3A and a separate state shown in FIG. 3B. As shown in FIG. 3A, in the contact state, the development roller 61 is in contact with the corresponding photoconductive drum 52. As shown in FIG. 3B, in the separate state, the development roller 61 is separated away from the corresponding photoconductive drum 52. In the color printer 1, it is possible to supply toner from the development roller 61 to the photoconductive drum 52 in the contact state. Meanwhile, in the separate state, the supply of toner from the development roller 61 to the photoconductive drum 52 is interrupted.

The switching mechanism 200 includes a pressing member 210 and a separating member 220 that are disposed on each side of each development cartridge 60 in the left-to-right direction. The switching mechanism 200 further includes a contact-separation cam 230 disposed on each side of the arranged development cartridges 60 in the left-to-right direction. The left-side pressing member 210 and the right-side pressing member 210 are formed bilaterally symmetrical to each other. The left-side separating member 220 and the right-side separating member 220 are formed bilaterally symmetrical to each other. The left-side contact-separation cam 230 and the right-side contact-separation cam 230 are formed bilaterally symmetrical to each other.

As shown in FIGS. 3A and 3B, the pressing member 210 is rotatable around a shaft 211, relative to the drawer 51. The pressing member 210 is urged counterclockwise in FIGS. 3A and 3B by an urging member (not shown). In the contact state shown in FIG. 3A, the pressing member 210 presses a projection 60B obliquely toward a lower rear side. The projection 60B is formed on a side surface of the development cartridge 60. Thus, each development roller 61 is brought into pressure contact with the corresponding photoconductive drum 52.

Figure 4:
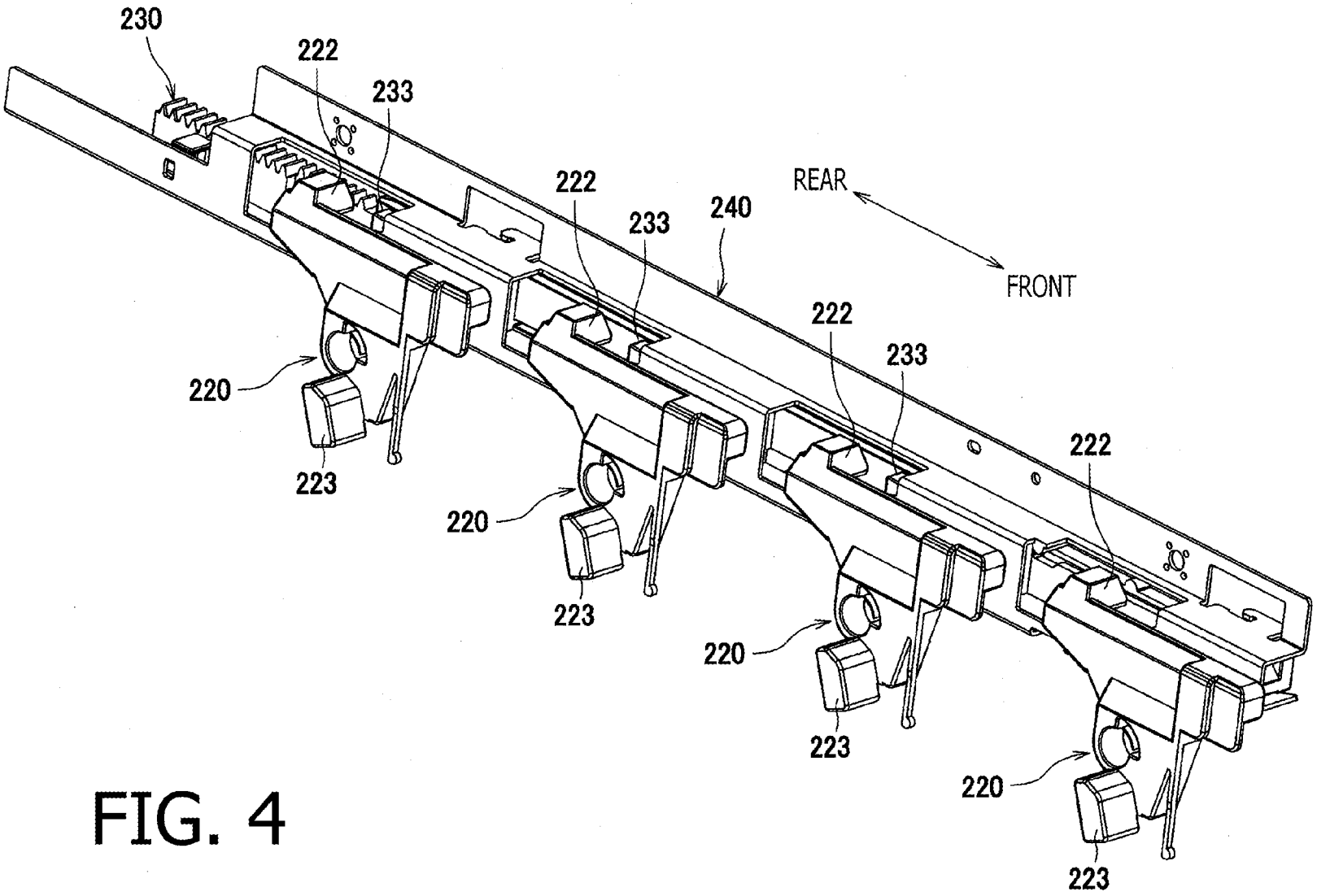
FIG. 4 is a perspective view showing separating members and a contact-separation cam slidably supported by a supporting member, in the first illustrative embodiment according to one or more aspects of the present disclosure.

The separating member 220 is rotatable around a shaft 221, relative to the drawer 51. The separating member 220 includes a contacted portion 222 and a pushing-up portion 223. As shown in FIG. 4, the four separating members 220 (on each side of the development cartridges 60 in the left-to-right direction) are arranged at regular intervals in the front-to-rear direction.

Figure 5:
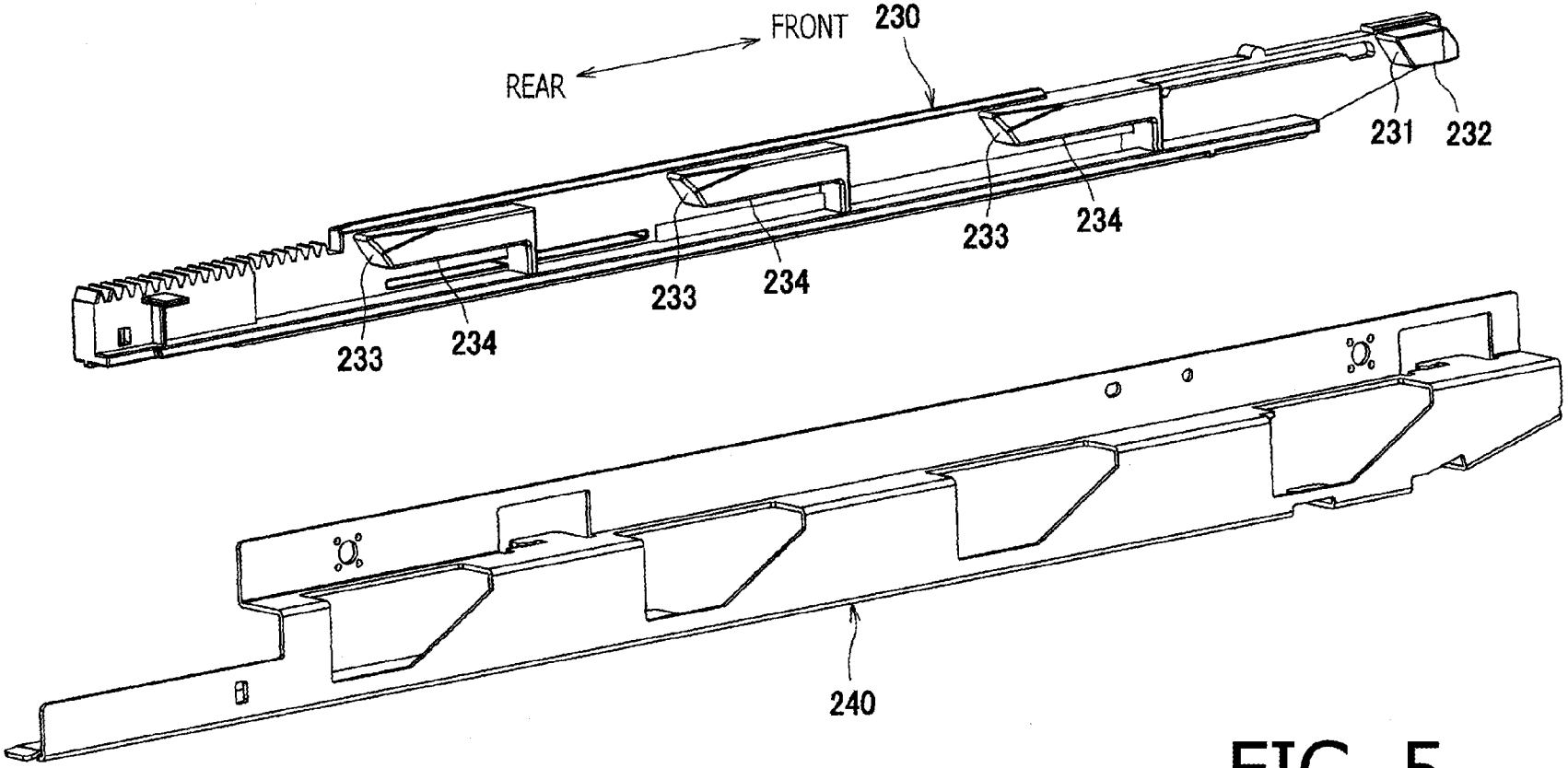
FIG. 5 is a perspective view showing the contact-separation cam and the supporting member in the first illustrative embodiment according to one or more aspects of the present disclosure.

The contact-separation cam 230 is supported to be slidable along the front-to-rear direction, by the main body 10 via a supporting member 240 fixedly attached to the main body 10. As shown in FIG. 5, the contact-separation cam 230 has a first cam surface 231, a first holding surface 232, three second cam surfaces 233, and three second holding surfaces 234. The three second cam surfaces 233 are arranged at regular intervals in the front-to-rear direction. The first cam surface 231 is positioned such that a distance between the first cam surface 231 and the second cam surface 233 adjacent to the first cam surface 231 is longer than a distance between the adjacent two of the second cam surfaces 233.

When the contact-separation cam 230 slides rearward from a state of a color mode (see FIG. 6A) where all the development rollers 61 are in the contact state, the second cam surfaces 233 come into contact with the corresponding contacted portions 222 and push down the contacted portions 222, respectively, as shown in FIG. 6B. Thereby, the corresponding separating members 220 rotate, and the corresponding pushing-up portions 223 push up the corresponding projections 60B of the corresponding development cartridges 60C, respectively. Thus, each of the three development rollers 61C for the colors other than black is switched to the separate state to be separated away from the corresponding photoconductive drum 52. Each development roller 61C is kept in the separate state as the corresponding contacted portions 222 are received and held by the corresponding second holding surfaces 234, respectively.

When the contact-separation cam 230 further slides rearward from a state of a monochrome mode (see FIG. 6B) where the development rollers 61C for the colors other than black are in the separate state, and where the development roller 61K for black is in the contact state, the first cam surface 231 comes into contact with the corresponding contacted portion 222 and pushes down the contacted portion 222 as shown in FIG. 6C. Thereby, the separating member 220 rotates, and the pushing-up portion 223 pushes up the projection 60B of the development cartridge 60K. Thus, the development roller 61K for black is switched to the separate state to be separated away from the corresponding photoconductive drum 52. The development roller 61K is kept in the separate state as the corresponding contacted portion 222 is received and held by the first holding surface 232.

When the contact-separation cam 230 slides frontward from a state of an all-separate mode (see FIG. 6C) where all the development rollers 61 are in the separate state, the engagement between the first holding surface 232 and the corresponding contacted portion 222 is released as shown in FIG. 6B. Thereby, the projection 60B of the development cartridge 60K is pushed down by the pressing member 210, and the development roller 61K for black is switched to the contact state to be in pressure contact with the corresponding photoconductive drum 52. Thus, the mode of the color printer 1 is switched to the monochrome mode. When the contact-separation cam 230 further slides frontward from the state of the monochrome mode shown in FIG. 6B, the engagement between each second holding surface 232 and the corresponding contacted portion 222 is released as shown in FIG. 6A. Thereby, the projection 60B of each development cartridge 60C is pushed down by the corresponding pressing member 210, and each development roller 61C for the colors other than black is switched to the contact state to be in pressure contact with the corresponding photoconductive drum 52. Thus, the mode of the color printer 1 is switched to the color mode.

<Configuration of New-Cartridge Determination Mechanism>

Figure 7A:
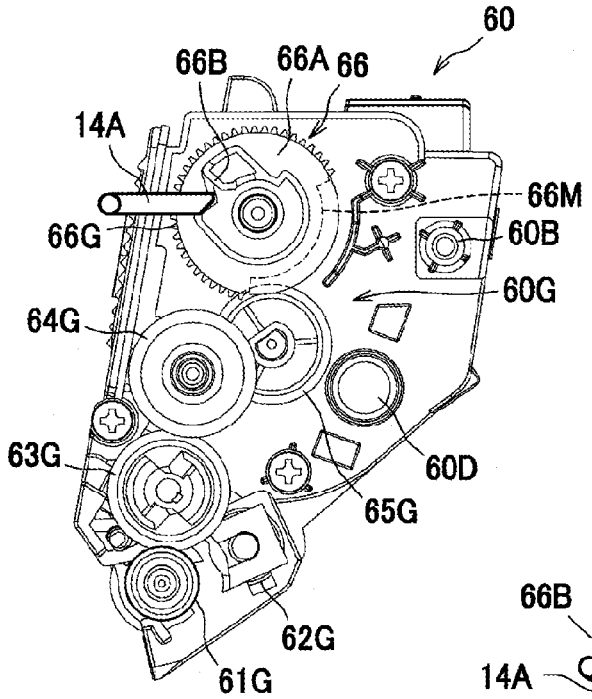
FIG. 7A is a left side view showing a development cartridge in a state where a detection projection is in a new-cartridge position, in the first illustrative embodiment according to one or more aspects of the present disclosure.

As shown in FIG. 7A, each development cartridge 60 includes, on a left side surface thereof, a gear mechanism 60G and a detection gear 66.

The gear mechanism 60G includes an input gear 63G, a development roller gear 61G, a supply roller gear 62G, an intermediate gear 64G, and an agitator gear 65G. To the input gear 63G, a driving force is input. The development roller gear 61G and the supply roller gear 62G engage with the input gear 63G. The agitator gear 65G engages the input gear 63G via the intermediate gear 64G. The development roller gear 610, the supply roller gear 620, and the agitator gear 65G are configured to rotate the development roller 61, the supply roller 62, and the agitator 65, respectively. In each development cartridge 60, in response to the driving force being input to the input gear 63G, the development roller 61, the supply roller 62, and the agitator 65 rotate.

The detection gear 66 includes a gear portion 66A and a detection projection 66B. The detection projection 66B protrudes from a left side surface of the gear portion 66A.

Figure 7B:
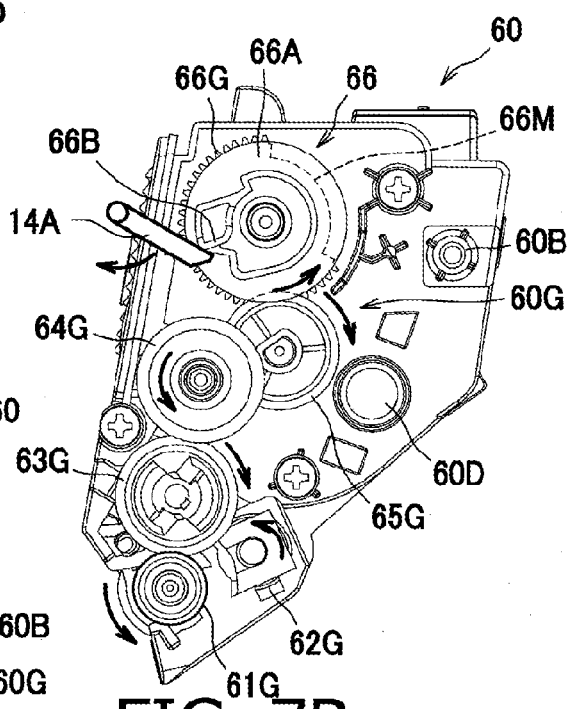
FIG. 7B is a left side view showing the development cartridge in a state where the detection projection is moving from the new-cartridge position to a used-cartridge position, in the first illustrative embodiment according to one or more aspects of the present disclosure.
Figure 7C:
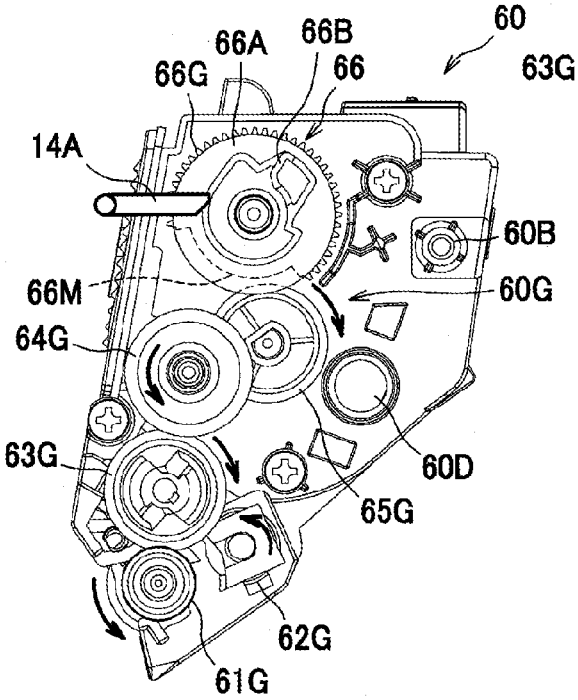
FIG. 7C is a left side view showing the development cartridge in a state where the detection projection is in the used-cartridge position, in the first illustrative embodiment according to one or more aspects of the present disclosure.

The gear portion 66A includes a gear tooth portion 66G at which gear tooth are formed, and a tooth lacking portion 66M at which there are no gear tooth formed. When the development cartridge 60 is a new cartridge as shown in FIG. 7A, the gear tooth portion 66G of the gear portion 66A engages with the agitator gear 65G. Therefore, when the development cartridge 60 is new, the detection gear 66 rotates in response to rotation of the agitator gear 65G. Meanwhile, when the development cartridge 60 is a used cartridge as shown in FIG. 7C, the tooth lacking portion 66M of the gear portion 66A faces the agitator gear 65G. Therefore, when the development cartridge 60 is a used cartridge, the detection gear 66 does not rotate even though the agitator gear 65G rotates.

When the detection gear 66 rotates from a posture thereof in a state where the development cartridge 60 is new, in conjunction with the gear mechanism 60G being driven, the engagement between the agitator gear 65G and the gear tooth portion 66G is released, and the tooth lacking portion 66M comes to face the agitator gear 65G. Thus, the detection gear 66 is prevented from rotating. Thereby, the detection projection 66B is configured to, in conjunction with the gear mechanism 60G being driven (i.e., the development roller 61 being rotated), irreversibly move from a new-cartridge position shown in FIG. 7A to a used-cartridge position shown in FIG. 7C.

As shown in FIG. 2, the main body 10 includes a driver 13 and a detector 14. The driver 13 is configured to input the driving force to the development cartridges 60. The detector 14 is configured to detect whether each individual development cartridge 60 is new.

The driver 13 includes four flexible joints 13A, a motor (not shown), and a gear train (not shown). Each of the four flexible joints 13A is configured to input the driving force to the input gear 63G of the corresponding development cartridge 60. The gear train is configured to transmit the driving force from the motor to the flexible joints 13A. For instance, each flexible joint 13A is configured to move back and forth relative to the development cartridge 60 in conjunction with the front cover 11 being closed and opened. Thereby, each flexible joint 13A is configured to engage with the input gear 63G of the corresponding development cartridge 60 when the development cartridge 60 is attached to the main body 10, and the front cover 11 is closed. Further, each flexible joint 13A is configured to input the driving force even though the development cartridge 60 is displaced by switching between the contact state and the separate state of the development roller 61 relative to the photoconductive drum 52.

The detector 14 is configured to detect a movement of each individual detection projection 66B from the new-cartridge position to the used-cartridge position. The detector 14 includes four combinations each including a detection arm 14A and an optical sensor 14B. The four combinations are provided corresponding to the four development cartridges 60, respectively.

The detection arm 14A is swingably attached to the drawer 51. The detection arm 14A is urged into a neutral position shown in FIG. 7A by an urging member (not shown). When a new development cartridge 60 is attached, and the driving force is input to the gear mechanism 600, as shown in FIG. 7B, the detection arm 14A is swung by its contact with the detection projection 66B moving from the new-cartridge position to the used-cartridge position. Then, as shown in FIG. 7C, the detection arm 14 returns to the neutral position after getting over the detection projection 66B. Further, when a used development cartridge 60 is attached, and the driving force is input to the gear mechanism 600, the detection projection 66B does not move from the used-cartridge position. Thus, since the detection projection 66B does not come into contact with the detection arm 14A, the detection arm 14 does not swing.

The optical sensor 14B is configured to detect a swing motion of the detection arm 14A. The optical sensor 14B is attached to the main body 10. When detecting a swing motion of the detection arm 14A, the optical sensor 14B outputs a particular signal to the controller 100.

<Configuration of Remaining Amount Determination Mechanism>

As shown in FIG. 8, each development cartridge 60 has two transparent light transmissive portions 60D. The two light transmissive portions 60D are provided at a left wall and a right wall that form the container 64, respectively. The two light transmissive portions 60D are disposed to face each other in the left-to-right direction. In order to determine an amount of toner remaining in the container 64 of each individual development cartridge 60, the main body 10 includes four combinations each including a light emitting element 15A and a light receiving element 15B. The four combinations are provided corresponding to the four development cartridges 60, respectively.

When the corresponding development cartridge 60 is attached to the main body 60, the light emitting element 15A and the light receiving element 15B are disposed to face each other across the two light transmissive portions 60D. The light emitting element 15A is configured to emit light (see a dashed line in FIG. 8) into the container 64 of the development cartridge 60 through one light transmissive portion 60D. The light receiving element 15B is configured to detect, through the other light transmissive portion 60D, light emitted by the light emitting element 15A and transmitted through the container 64. The light emitting element 15B outputs a detection signal depending on an intensity of the detected light.

When the container 64 is full of toner, the light emitted by the light emitting element 15A is interrupted by the toner. In this case, the light emitting element 15B hardly detects the light. When the amount of the toner remaining in the container 64 is reduced by toner consumption, the intensity of the light detected by the light receiving element 15B becomes larger. Thus, in the color printer 1, the amount of the toner remaining in each individual development cartridge 60 is determined by using a change in the intensity of the light detected by the light receiving element 15B.

<Configuration of Controller>

The controller 100 is configured to, by controlling the driver 13 and the switching mechanism 200, control operations of the color printer 1 such as driving the development cartridges 60 and switching between the contact state and the separate state of the development rollers 61 relative to the photoconductive drums 52. The controller 100 includes a CPU (which is an abbreviated form of "Central Processing Unit," not shown), a RAM (which is an abbreviated form of "Random Access Memory," not shown), a ROM (which is an abbreviated form of "Read Only Memory," not shown), and an input/output interface. The controller 100 is configured to control each of elements included in the color printer 1 by performing arithmetic processing based on outputs from various sensors and previously-set programs.

When receiving a print job containing image data, the controller 100 performs a printing operation to form an image on a sheet S by transferring and thermally fixing toner images on the sheet S. Further, when a predetermined condition is satisfied (e.g., when the color printer 1 is powered on, or when the front cover 11 is brought into a closed state from an open state), the controller 100 performs an initializing operation.

The initializing operation is an operation of making necessary preparations for execution of the printing operation. As shown in FIG. 9, the controller 100 is configured to, in the initializing operation, perform a preparatory mode, a density adjustment mode, and a cleaning mode in the aforementioned sequence.

The preparatory mode is an operational mode to make preparations for forming toner images on the photoconductive drums 52 and transferring the toner images onto a transfer object. More specifically, in the first illustrative embodiment, the preparatory mode is a mode to make preparations for the printing operation to transfer the toner images onto a sheet S as an example of the transfer object, and is also a mode to make preparations for the density adjustment mode, to be executed after the preparatory mode, to transfer the toner images onto the conveyance belt 73 as another example of the transfer object.

During execution of the preparatory mode, the controller 100 rotates each of the development rollers 61 in a state (hereinafter referred to as an "all separation mode") where the separate state is maintained between all the photoconductive drums 52 and the corresponding development rollers 61. Therefore, in a case where the color printer 1 is in the color mode or the monochrome mode when the color printer 1 is powered on or when the front cover 11 is closed, the controller 100 firstly controls the switching mechanism 200 to switch to the all separation mode from the color mode or the monochrome mode.

When the color printer 1 is powered on, or when the front cover 11 is closed, as shown at a time t1 in FIG. 9, the controller 100 inputs the driving force to the development rollers 61 (the development cartridges 60), the photoconductive drums 52, and the conveyance belt 73, and applies a charging bias to the chargers 53 (chargers ON). Thereby, the development rollers 61, the photoconductive drums 52, and the conveyance belt 73 are driven to rotate, and the surfaces of the photoconductive drums 52 are evenly charged.

Further, the controller 100 rotates the agitators 65 when rotating the development rollers 61 while maintaining the all separation mode (see the times t1-t3). In the first illustrative embodiment, in response to the driving force being input to the development cartridges 60 (the gear mechanisms 60G), the development rollers 61 are driven to rotate. Further, in conjunction with the rotation of the development rollers 61, the agitators 65 are driven to rotate. Thereby, the toner in the container 64 of each development cartridge 60 is agitated.

Further, the controller 100 determines a state of each development cartridge 60 when rotating the development rollers 61 while maintaining the all separation mode. More specifically, as shown from the time t1 to the time t3 in FIG. 9, when rotating the development rollers 61 while maintaining the all separation mode, the controllers 100 determines whether each individual development cartridge 60 is new (new-cartridge determination ON), and also determines the amount of the toner remaining in the container 64 of each individual development cartridge 60 (remaining amount determination ON).

Specifically, with respect to each development cartridge 60, when the detector 14 has detected a movement of the detection projection 66B from the new-cartridge position shown in FIG. 7A to the used-cartridge position shown in FIG. 7C (when the optical sensor 14B has detected a swing motion of the detection arm 14A), the controller 100 determines that the development cartridge 60 is new. Further, when the detector 14 has not detected a movement of the detection projection 66B from the new-cartridge position to the used-cartridge position (when the optical sensor 14B has not detected a swing motion of the detection arm 14A), the controller 100 determines that the development cartridge 60 is not new.

In addition, the controller 100 determines the amount of the toner remaining in the container 64 on the basis of the detection signal (i.e., a detection result) from the light receiving element 15B shown in FIG. 8. More specifically, when the intensity of the light detected by the light receiving element 15B is small, the controller 100 determines that the amount of the toner remaining in the container 64 is large. Meanwhile, when the intensity of the light detected by the light receiving element 15B is large, the controller 100 determines that the amount of the toner remaining in the container 64 is small. The color printer 1 is configured to, when determining that the amount of the toner remaining in the container 64 is equal to or less than a predetermined amount, provide a user with a message that the development cartridge 60 should be replaced with a new one.

As shown at the time t2 in FIG. 9, the controller 100 starts performing a cleaning operation to clean the surfaces of the photoconductive drums 52 and the conveyance belt 73 when rotating the development rollers while maintaining the all separation mode. Specifically, when a first period of time T1 has elapsed since the input of the driving force to the development cartridges 60, the photoconductive drums 52, and the conveyance belt 73, the controller 100 applies a bias for returning the toner being held by the holding rollers 54 to each photoconductive drum 52, applies a transfer bias to each transfer roller 74, and applies a bias for retrieving the toner adhering to the surface of the conveyance belt 73 to the cleaning roller 91 (cleaning ON). Thereby, the toner on the holding rollers 54 is transferred onto the photoconductive drums 52. Additionally, the toner on the photoconductive drums 52 is transferred onto the conveyance belt 73. Furthermore, the toner on the conveyance belt 73 is retrieved by the cleaning unit 90.

As shown at the time t3 in FIG. 9, when a second period of time T2 has elapsed since the input of the driving force to the development cartridges 60, the photoconductive drums 52, and the conveyance belt 73, the controller 100 stops inputting the driving force to the development cartridges 60. Thereby, the rotation of each development roller 61 and each agitator 65 is halted.

As shown at a time t4 in FIG. 9, when a third period of time T3 has elapsed since the controller 100 stopped inputting the driving force to the development cartridges 60, the controller 100 stops inputting the driving force to the photoconductive drums 52 and the conveyance belt 73, and also stops applying the biases to the chargers 53, the holding rollers 54, the transfer rollers 74, and the cleaning roller 91. Thereby, the cleaning operation of cleaning the surfaces of the photoconductive drums 52 and the conveyance belt 73 is terminated.

The density adjustment mode is an operational mode to determine correction values for adjusting densities of an image to be formed on a sheet S. More specifically, in the density adjustment mode, the controller 100 determines a correction value for adjusting a density of each color, by forming a toner image of a predetermined pattern on each photoconductive drum 52, transferring the toner images onto the conveyance belt 73, and detecting by an optical sensor (not shown) the densities of the toner images transferred on the conveyance belt 73. Since control for determining the correction values has been known, a detailed explanation of the control will be omitted. It is noted that the toner images for the density correction may be transferred not onto the conveyance belt 73 but onto a sheet S fed from the sheet feeder 20.

To perform the density adjustment mode, the controller 100 controls the switching mechanism 200 to switch from the separate state to the contact state between each photoconductive drum 52 and the corresponding development roller 61 at a point of time when a charged surface of the photoconductive drum 52 is allowed to contact the development roller 61. Specifically, as shown at a time t5 in FIG. 9, when the density adjustment mode is started, the controller 100 firstly input the driving force to the development cartridges 60, the photoconductive drums 52, and the conveyance belt 73, and applies the charging bias to the chargers 53. Thereby, the development rollers 61, the photoconductive drums 52, and the conveyance belt 73 are driven to rotate, and the surfaces of the photoconductive drums 52 are evenly charged by the chargers 53.

Then, as shown at a time t6 in FIG. 9, when a fourth period of time T4 has elapsed since the input of the driving force to the development cartridges 60, the photoconductive drums 52, and the conveyance belt 73, the controller 100 controls the switching mechanism 200 to switch from the all separation mode to the color mode in which all the photoconductive drums 52 are in contact with the corresponding development rollers 61. Thereby, the development rollers 61 are brought into contact with the charged surfaces of the corresponding photoconductive drums 52, respectively. For instance, the fourth period of time T4 may be set to a period of time required for a charged part, which is charged when the charging bias begins to be applied to each charger 53, of the surface of each photoconductive drum 52 to move to a position at least facing the corresponding development roller 61.

After switching to the color mode, the controller 100 determines the correction values. After completion of determining the correction values, as shown at a time t7 in FIG. 9, the controller 100 stops inputting the driving force to the development cartridges 60, the photoconductive drums 52, and the conveyance belt 73, and also stops applying the charging bias to the chargers 53. As shown at a time t8 in FIG. 9, when a fifth period of time T5 has elapsed since the controller 100 stopped inputting the driving force to the development cartridges 60, the photoconductive drums 52, and the conveyance belt 73, the controller 100 controls the switching mechanism 200 to switch from the color mode to the all separation mode.

The cleaning mode is an operational mode to clean the surfaces of the photoconductive drums 52 on which the toner images have been formed in the density adjustment mode and clean the surface of the conveyance belt 73 onto which the toner images have been transferred in the density adjustment mode. Specifically, after completion of the density adjustment mode, as shown at a time t9 in FIG. 9, the controller 100 inputs the driving force to the photoconductive drums 52 and the conveyance belt 73, and also applies predetermined biases to the holding rollers 54, the transfer rollers 74, and the cleaning roller 91. Thereby, the surfaces of the photoconductive drums 52 and the conveyance belt 73 are cleaned. It is noted that the cleaning mode is a mode to make preparations for a printing operation to form toner images on the photoconductive drums 52 and transferring the toner images onto a sheet S as a transfer object. Hence, the cleaning mode may be considered as being included in the preparatory mode.

As shown at a time t10 in FIG. 9, when a sixth period of time T6 has elapsed since the controller 100 started the cleaning operation, the controller 100 stops inputting the driving force to the photoconductive drums 52 and the conveyance belt 73, and also stops applying the biases to the transfer rollers 74 and the cleaning roller 91.

After completion of the initializing operation, the controller 100 places the color printer 1 in a ready state until the controller 100 receives a print job.

When receiving a print job, the controller 100 performs a printing operation of forming an image on a sheet S. In response to the received print job, the controller 100 controls the switching mechanism 200 to switch from the all separation mode to one of the color mode and the monochrome mode, and performs image formation on the sheet S. To perform the printing operation, in the same manner as when the controller 100 performs the density adjustment mode, the controller 100 controls the switching mechanism 200 to switch from the separate state to the contact state between each photoconductive drum 52 to be used for the printing operation and the corresponding development roller 61 at a point of time when a charged surface of the photoconductive drum 52 is allowed to contact the development roller 61.

According to the first illustrative embodiment, during execution of the preparatory mode, the controller 100 controls the development rollers 61 to rotate while maintaining the separate state. Therefore, even though the development rollers 61 are rotated during execution of the preparatory mode, the photoconductive drums 52 are prevented from being supplied with toner. Thereby, it is possible to prevent the photoconductive drums 52 from being contaminated with toner and prevent wasteful consumption of toner.

Further, in the first illustrative embodiment, the controller 100 controls the agitators 65 to rotate when rotating the development rollers 61 while maintaining the separate state. Therefore, it is possible to agitate the toner in each development cartridge 60 in the preparatory mode. Thereby, it is possible to make appropriate a development property of the toner stored in each development cartridge 60.

Further, in the first illustrative embodiment, the controller 100 determines the state of each development cartridge 60 when rotating the development rollers 61 while maintaining the separate state. Therefore, it is possible to determine the state of each development cartridge 60 in the preparatory mode. Specifically, the controller 100 determines whether each individual development cartridge 60 is new, based on whether the detection projection 66B has moved from the new-cartridge position to the used-cartridge position. Therefore, it is possible to determine in the preparatory mode whether each individual development cartridge 60 is new. In addition, when rotating the development rollers 61 while maintaining the separate state, the controller 100 determines the amount of the toner remaining in each individual container 64 based on the detection result of the light receiving element 15B. Therefore, it is possible to determine the amount of the toner remaining in each individual container 64 in the preparatory mode. In the first illustrative embodiment, to determine the amount of the toner remaining in each individual container 64, the controller 100 controls each agitator 65 to rotate and agitate the toner in the corresponding container 64. Thus, it is possible to more accurately determine the amount of the toner remaining in each individual container 64 than when the toner is not agitated.

Further, in the first illustrative embodiment, the controller 100 controls the cleaning unit 90 to clean the surfaces of the photoconductive drums 52 when rotating the development rollers 61 while maintaining the separate state between each development roller 61 and the corresponding photoconductive drum 52. Therefore, it is possible to clean the surface of each photoconductive drum 52 in a state where each photoconductive drum 52 is separated away from the corresponding development roller 61. Thereby, it is possible to prevent toner remaining on the surface of a photoconductive drum 52 from attaching onto the surface of the corresponding development roller 61 when the photoconductive drum 52 is brought into contact with the development roller 61.

Further, in the first illustrative embodiment, to perform the printing operation or the density adjustment mode, the controller 100 controls the switching mechanism 200 to switch from the separate state to the contact state at a point of time when a charged surface of each photoconductive drum 52 to be used is allowed to contact the corresponding development roller 61. Therefore, it is possible to prevent toner from unnecessarily attaching onto the photoconductive drum 52 in switching from the separate state to the contact state. Thereby, it is possible to further prevent the photoconductive drum 52 from being contaminated with toner and further prevent wasteful consumption of toner.

In the first illustrative embodiment, FIGS. 7A to 7C exemplify a configuration of a new-cartridge determination mechanism. Nonetheless, the new-cartridge determination is not limited to the exemplified configuration, and may be configured in a different manner.

Second Illustrative Embodiment

Subsequently, an explanation will be provided of a second illustrative embodiment according to aspects of the present disclosure. In the second illustrative embodiment, a configuration and control for the new-cartridge determination are different from those exemplified in the first illustrative embodiment. Therefore, hereinafter, different features from the first illustrative embodiment will be described. With respect to substantially the same features as exemplified in the first illustrative embodiment, an explanation of them will be omitted.

As shown in FIG. 10, each development cartridge 60 includes an IC chip 67 instead of the detection gear 66 exemplified in the first illustrative embodiment. The IC chip 67 is configured to store information for determining whether the development cartridge 60 having the IC chip 67 is new. As the information for determining whether the development cartridge 60 having the IC chip 67 is new, various kinds of information may be cited such as information on the number of sheets printed since the last replacement of the development cartridge 60, information on the number of rotations of the development roller 61 since the last replacement of the development cartridge 60, and information on the number of dots transferred onto sheets S since the last replacement of the development cartridge 60.

Instead of the detectors 14 exemplified in the first illustrative embodiment, the main body 10 includes information readers 16. Each information reader 16 is configured to read the information from the IC chip 67 of a corresponding one of the development cartridges 60 attached to the main body 10.

The controller 100 is configured to perform a printing operation and an initializing operation. As shown in FIG. 11, the controller 100 is configured to perform, in the initializing operation, a preparatory mode, a density adjustment mode, and a cleaning mode in the aforementioned sequence.

In the preparatory mode, the controller 100 determines whether each individual development cartridge 60 is new, based on the information read by a corresponding one of the information readers 16, when rotating the development rollers 61 while maintaining the all separation mode. Specifically, during a period between the time t1 at which the driving force is input to the development rollers 61 and the time t2 for "cleaning ON," the controller 100 acquires the information from the information readers 16, and determines whether each individual development cartridge 60 is new based on the acquired information. More specifically, for instance, when the information on the number of sheets printed since the last replacement of a development cartridge 60 indicates "0," the controller 100 determines that the development cartridge 60 is new. Meanwhile, when the information does not indicate "0," the controller 100 determines that the development cartridge 60 is not new.

According to the second illustrative embodiment described above, it is possible to obtain the same operations and effects as exemplified in the first illustrative embodiment. Further, in the second illustrative embodiment, the controller 100 determines whether each individual development cartridge 60 is new, based on the information read by a corresponding one of the information readers 16, when rotating the development rollers 61 while maintaining the separate state between each development roller 61 and the corresponding photoconductive drum 52. Therefore, it is possible to make, at the same timing, a preparation (a preparation for the density adjustment mode) for forming a toner image on each photoconductive drum 52 and transferring the toner images onto a transfer object and a determination as to whether each individual development cartridge 60 is new based on the information read from each IC chip 67. Thereby, it is possible to shorten a period of time until the controller 100 becomes allowed to perform the density adjustment mode. Thus, it is possible to shorten a period of time for the initializing operation as a whole. Thereby, it is possible to shorten a period of time until the controller 100 becomes allowed to perform the printing operation since the color printer 1 has been powered on, or since the front cover 11 has been closed.

In the second illustrative embodiment, the determination as to whether each individual development cartridge 60 is new may be made at any point of time between the time t1 and the time t3 in FIG. 11. Further, in the second illustrative embodiment, when the color printer 1 is configured to manage an amount of consumed toner (or an amount of remaining toner) on the basis of information on the number of dots that is stored in the IC chips 67, the color printer 1 may not have an optical remaining amount determination mechanism as shown in FIG. 8.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

[Modification]

In the aforementioned illustrative embodiments, each development roller 61 is configured to move relative to a corresponding one of the photoconductive drums 52. Nonetheless, each photoconductive drum 52 may be configured to move relative to a corresponding one of the development rollers 61. Further, each development roller 61 and each photoconductive drum 52 may be configured to move relative to the corresponding photoconductive drum 52 and the corresponding development roller 61, respectively.

In the aforementioned illustrative embodiments, the scorotron chargers 53 each of which includes the grid electrode are exemplified. Nonetheless, instead of the scorotron chargers 53, scorotron chargers may be employed. Further, in the aforementioned illustrative embodiments, each charger 53 includes the charging wire. Nonetheless, for instance, each charger may include needle-like electrodes arranged, instead of the charging wire. Further, charging rollers may be employed instead of the chargers 53.

In the aforementioned illustrative embodiments, the main body 10 includes, at the front end portion thereof, the opening 10A through which the development cartridges 60 are detachably attached, and the front cover 11 configured to open and close the opening 10A. Nonetheless, for instance, an opening through which the development cartridges 60 are detachably attached and a cover configured to open and close the opening may be provided at an upper end portion, a left end portion, or a right end portion of the main body 10.

In the aforementioned illustrative embodiments, each photoconductive drum 52 and the corresponding development cartridge 60 are separately supported by the drawer 51. Nonetheless, for instance, each photoconductive drum 52 and the corresponding development cartridge 60 may be integrated as a single process cartridge. In this case, each process cartridge may be configured such that a development cartridge is detachably attached to a unit having a photoconductive drum.

Each development cartridge 60 may be configured such that a unit (e.g., a toner box) having a container configured to accommodate toner is detachably attached to another unit having a development roller and a layer thickness regulating blade.

In the aforementioned illustrative embodiments, the agitators 65 are exemplified as agitating members configured to rotate and agitate developer stored in the development cartridges 60. Nonetheless, for instance, augers may be employed instead of the agitators 65.

In the aforementioned illustrative embodiments, in the all separation mode, a remaining toner amount determination is made with respect to each development cartridge 60, while rotating the corresponding development roller 61 and the corresponding agitator 65. Nonetheless, for instance, in the monochrome mode, a remaining toner amount determination may be made with respect to each of the development cartridges 60C (other than the development cartridge 60K for black in which the development roller 61 is separated away from the photoconductive drum 52), while rotating the corresponding development roller 61 and the corresponding agitator 65.

In the aforementioned illustrative embodiments, as an image forming apparatus according to aspects of the present disclosure, the color printer 1 is exemplified that includes a plurality of combinations each including a photoconductive drum 52 and a development cartridge 60 (a development unit) and is configured to form a color image. Nonetheless, for instance, the image forming apparatus according to aspects of the present disclosure may be a printer that includes a single photoconductive drum and a single development unit and is configured to only form a monochrome image. Further, the image forming apparatus according to aspects of the present disclosure may be a copy machine or a multi-function peripheral having a document reader such as a flatbed scanner.

What is claimed is:

1. An image forming apparatus comprising:

a main body;

a photoconductive drum;

a charger configured to charge the photoconductive drum;

a development cartridge comprising:

a development roller, the development cartridge being detachably attached to the main body;

a switching mechanism configured to switch between:

a contact state where the development roller and the photoconductive drum are in contact with each other; and a separate state where the development roller and the photoconductive drum are separated away from each other;

a controller configured to:

perform a preparatory mode to make preparations for forming a developer image on the photoconductive drum and transferring onto a transfer object the developer image formed on the photoconductive drum; and during execution of the preparatory mode, rotate the development roller while maintaining the separate state between the development roller and the photoconductive drum; and a detected portion configured to, in conjunction with rotation of the development roller, irreversibly move from a new-unit position where the detected portion is when the development cartridge is new to a used-unit position where the detected portion is when the development cartridge is not new, wherein the main body comprises a detector configured to detect a movement of the detected portion from the new-unit position to the used-unit position, and wherein the controller is further configured to:

when the detected portion is in the new-unit position, place the switching mechanism in the separate state;

after the detector detects movement of the detected portion from the new-unit position to the used-unit position, control the switching mechanism to switch from the separate state to the contact state; and after the charger has charged the photoconductive drum, control the switching mechanism to switch from the separate state to the contact state.

2. The image forming apparatus according to claim 1, wherein the controller is further configured to perform the preparatory mode in an initializing operation of making preparations for an image forming operation.

3. The image forming apparatus according to claim 1, wherein the controller is further configured to determine a state of the development cartridge, when rotating the development roller while maintaining the separate state between the development roller and the photoconductive drum.

4. The image forming apparatus according to claim 3, wherein the controller is further configured to:

determine that the development cartridge is new, when the detector detects the movement of the detected portion from the new-unit position to the used-unit position when the controller is rotating the development roller while maintaining the separate state between the development roller and the photoconductive drum; and determine that the development cartridge is not new, when the detector does not detect the movement of the detected portion from the new-unit position to the used-unit position when the controller is rotating the development roller while maintaining the separate state between the development roller and the photoconductive drum.

5. The image forming apparatus according to claim 3, wherein the development cartridge comprises a container configured to accommodate developer, and wherein the main body comprises:

a light emitting element configured to emit light into the container of the development cartridge; and a light receiving element configured to detect light emitted by the light emitting element and transmitted through the container, and wherein the controller is further configured to determine an amount of developer remaining in the container based on a detection result of the light receiving element when rotating the development roller while maintaining the separate state between the development roller and the photoconductive drum.

6. The image forming apparatus according to claim 5, wherein the development cartridge further comprises an agitator configured to agitate the developer in the container by rotating in conjunction with rotation of the development roller.

7. The image forming apparatus according to claim 3, wherein the development cartridge comprises a memory storing information for determining whether the development cartridge is new, wherein the main body comprises an information reader configured to read the information from the memory of the development cartridge attached to the main body, and wherein the controller is further configured to determine whether the development cartridge is new based on the information read by the information reader, when rotating the development roller while maintaining the separate state between the development roller and the photoconductive drum.

8. The image forming apparatus according to claim 1, wherein the development cartridge comprises an agitator configured to rotate and agitate developer stored in the development cartridge, and wherein the controller is further configured to rotate the agitator when rotating the development roller while maintaining the separate state between the development roller and the photoconductive drum.

9. The image forming apparatus according to claim 1, wherein the controller is further configured to perform the preparatory mode when the image forming apparatus is powered on.

10. The image forming apparatus according to claim 1, wherein the main body has:

an opening through which the development cartridge is detachably attached to the main body; and a cover openable and closable relative to the main body, the cover being configured to, when closed, close the opening, and wherein the controller is further configured to perform the preparatory mode when the cover is closed.

11. The image forming apparatus according to claim 1, further comprising a plurality of combinations each of the combinations including the photoconductive drum and the development cartridge, wherein the controller is further configured to, during execution of the preparatory mode, rotate each of the development rollers while maintaining the separate state between each of the development rollers and a corresponding one of the photoconductive drums.

12. The image forming apparatus according to claim 1, wherein the controller is further configured to perform a cleaning operation of cleaning a surface of the photoconductive drum when rotating the development roller while maintaining the separate state between the development roller and the photoconductive drum.

13. An image forming apparatus comprising:

a main body;

a photoconductive drum;

a charger configured to charge the photoconductive drum;

a development cartridge comprising a development roller, the development cartridge being detachably attached to the main body;

a switching mechanism configured to switch between:

a contact state where the development roller and the photoconductive drum are in contact with each other; and a separate state where the development roller and the photoconductive drum are separated away from each other;

a controller configured to:

perform an initializing operation of making preparations for an image forming operation; and during execution of the initializing operation, rotate the development roller while maintaining the separate state between the development roller and the photoconductive drum; and a detected portion configured to, in conjunction with rotation of the development roller, irreversibly move from a new-unit position where the detected portion is when the development cartridge is new to a used-unit position where the detected portion is when the development cartridge is not new, wherein the main body comprises a detector configured to detect a movement of the detected portion from the new-unit position to the used-unit position, and wherein the controller is further configured to:

when the detected portion is in the new-unit position, place the switching mechanism in the separate state;

after the detector detects movement of the detected portion from the new-unit position to the used-unit position, control the switching mechanism to switch from the separate state to the contact state; and after the charger has charged the photoconductive drum, control the switching mechanism to switch from the separate state to the contact state.

14. The image forming apparatus according to claim 13, wherein the controller is further configured to, in the initializing operation, determine a state of the development cartridge, when rotating the development roller while maintaining the separate state between the development roller and the photoconductive drum.

15. The image forming apparatus according to claim 14, wherein the controller is further configured to:

determine that the development cartridge is new, when the detector detects the movement of the detected portion from the new-unit position to the used-unit position when the controller is rotating the development roller while maintaining the separate state between the development roller and the photoconductive drum; and determine that the development cartridge is not new, when the detector does not detect the movement of the detected portion from the new-unit position to the used-unit position when the controller is rotating the development roller while maintaining the separate state between the development roller and the photoconductive drum.

16. The image forming apparatus according to claim 14, wherein the development cartridge comprises a container configured to accommodate developer, and wherein the main body comprises:

a light emitting element configured to emit light into the container of the development cartridge; and a light receiving element configured to detect light emitted by the light emitting element and transmitted through the container, and wherein the controller is further configured to determine an amount of developer remaining in the container based on a detection result of the light receiving element when rotating the development roller while maintaining the separate state between the development roller and the photoconductive drum.

17. The image forming apparatus according to claim 16, wherein the development cartridge further comprises an agitator configured to agitate the developer in the container by rotating in conjunction with rotation of the development roller.

18. The image forming apparatus according to claim 14, wherein the development cartridge comprises a memory storing information for determining whether the development cartridge is new, wherein the main body comprises an information reader configured to read the information from the memory of the development cartridge attached to the main body, and wherein the controller is further configured to determine whether the development cartridge is new based on the information read by the information reader, when rotating the development roller while maintaining the separate state between the development roller and the photoconductive drum.

19. The image forming apparatus according to claim 13, wherein the development cartridge comprises an agitator configured to rotate and agitate developer stored in the development cartridge, and wherein the controller is further configured to rotate the agitator when rotating the development roller while maintaining the separate state between the development roller and the photoconductive drum.

20. The image forming apparatus according to claim 13, wherein the controller is further configured to perform the initializing operation when the image forming apparatus is powered on.

21. The image forming apparatus according to claim 13, wherein the main body has:

an opening through which the development cartridge is detachably attached to the main body; and a cover openable and closable relative to the main body, the cover being configured to, when closed, close the opening, and wherein the controller is further configured to perform the initializing operation when the cover is closed.

22. The image forming apparatus according to claim 13, further comprising a plurality of combinations each of the combinations including the photoconductive drum and the development cartridge, wherein the controller is further configured to, during execution of the initializing operation, rotate each of the development rollers while maintaining the separate state between each of the development rollers and a corresponding one of the photoconductive drums.

23. The image forming apparatus according to claim 13, wherein the controller is further configured to, in the initializing operation, perform a cleaning operation of cleaning a surface of the photoconductive drum when rotating the development roller while maintaining the separate state between the development roller and the photoconductive drum.

* * * * *